United States Patent [19]

Lighthall et al.

[11] Patent Number: 4,934,393

[45] Date of Patent: Jun. 19, 1990

[54] SPRAY GUN CLEANING APPARATUS

[75] Inventors: John S. Lighthall, 934 Bay St., Santa Cruz, Calif. 95060; Homer H. Lighthall, Santa Cruz, Calif.

[73] Assignee: John S. Lighthall, Santa Cruz, Calif.

[21] Appl. No.: 213,322

[22] Filed: Jun. 30, 1988

[51] Int. Cl.[5] ..... B08B 3/04

[52] U.S. Cl. ..... 134/104.4; 134/166 C; 134/102; 55/320; 55/441; 55/468; 239/106; 118/302

[58] Field of Search ..... 134/99, 102, 104, 105, 134/166 C, 169 C, 200, 201, 104.2, 104.4; 239/106, 112; 55/320, 441, 468; 118/302

[56] References Cited

U.S. PATENT DOCUMENTS 2,745,418 5/1956 Balcom et al. ..... 134/103

4,025,363 5/1977 DeSantis ..... 134/102

*Primary Examiner*—Frankie L. Stinson

*Attorney, Agent, or Firm*—The Dulin Law Firm

[57] ABSTRACT

A spray gun cleaning apparatus for containing and collecting toxic materials resulting from cleaning a spray gun with a cleaning fluid is disclosed. The apparatus includes an interior airflow passageway, a receptacle at an inflow end of the passageway for receiving the spray from the spray gun nozzle, and an outlet at the other end of the passageway for discharging airflow into the ambient environment. At least one filter/condenser is located within the passageway for condensing cleaning fluid vapor into liquid which flows into a waste container, preferably by gravity flow. The apparatus further includes a negative pressure generator connected to a source to compressed air for generating a negative air pressure within the passageway relative to ambient in a manner which causes air to flow through the filter/condenser so that cleaning fluid vapors sprayed from the gun nozzle during cleaning are substantially contained, condensed and removed by the filter/condenser before being returned to the ambient, the removed cleaning fluid and other toxic material such as waste paint flowing safely into the waste container. The spray gun is also connected to the source of compressed air and drives the cleaning fluid from the gun into the receptacle as an atomized spray.

25 Claims, 5 Drawing Sheets

SPRAY GUN CLEANING APPARATUS

FIELD

The present invention relates to cleaning systems for cleaning air pressure powered spray guns. More particularly, the present invention relates to a novel spray gun cleaning apparatus which enables the gun nozzle and related plumbing to be cleaned in a manner limiting discharge of cleaning liquids, vapors, aerosols, and the like, into the ambient atmosphere.

BACKGROUND

While apparatus and methods have been proposed in the prior art for cleaning pneumatic pressure operated spray guns, whether for paint or other liquid materials, a hitherto unsolved need has arisen for a more effective cleaning apparatus which is simple, yet effective in minimizing discharge of unwanted, and often very toxic or dangerous chemicals into the ambient environment at the clean up area.

For example, the Constantino U.S. Pat. No. 2,569,125 described a cleaning device for spray gun nozzles. The device essentially comprised three parts: a main reservoir tank, an auxiliary tank formed at one end of the main reservoir tank, and a hood or shroud portion over the main reservoir tank. A spray gun had its nozzle end inserted into a hole at the auxiliary tank end of the hood and had its suction tube inserted into the auxiliary tank which was filled with a suitable cleaning solvent. Then, air under pressure was flowed through the nozzle and sucked up cleaning fluid by operation of a venturi between the suction tube and a main airflow line leading to the nozzle. The droplets of cleaning fluid were said to be condensed and collected on the inside walls of the shroud and thereupon be returned by gravity flow into the main reservoir tank.

U.S. Pat. Nos. 4,460,126 and 4,534,802 to Gates et al., and U.S. Pat. No. 4,204,977 to Zwirlein disclose apparatus and methods directed to purging polyurethane foam spray gun apparatus. In Zwirlein, for example, positive pressure is provided through the gun to circulate solvent during periods of non-use in order to prevent any urethane foam within the gun and its nozzle from hardening. Complex pumping apparatus was required in order to carry out the necessary recirculation during periods of non use of the gun.

U.S. Pat. No. 3,876,114 to Hicks et al, describes a cleaning apparatus for a hand held dispensing gun of the type used for dispensing synthetic resin liquid material. The air powered flush system first injected a small quantity of solvent into the mixing chamber of the gun, the then followed with a high pressure air blast which atomized the solvent and caused it to flush out all of the resin that might have remained in the mixing chamber within the gun.

U.S. Pat. No. 3,240,225 to Barrows describes a turreted assembly for automatically connecting a wide variety of paint sources (typically holding different colored paints) to a single spray gun. This special apparatus included a purging cycle to purge the nozzle of the last used paint before the next used paint entered the gun. The application described for this special apparatus was assembly line painting of automobiles. Furthermore, in European Patent Application No. E.P. 230,245 published July 29, 1987, of L. E. Stern et al, another cleaning device for spray guns is described. It comprises a suction system that generates a suction through a connecting element attached to the nozzle of the spray gun. With the suction system activated, cleaning solvent is sucked from the paint supply reservoir (can) portion of the gun through its discharge nozzle, directly into a confined filter, and thence to one or more waste collecting containers. The gun itself is neither connected to an independent source of compressed air nor is the trigger of the gun activated during cleaning. As a result the suction system must be positioned closely adjacent to the spray gun to maximize suction since the flow of the solvent/paint mixture from the spray gun is only a function of the relative low pressure generated by the suction system. Also there is not enough space to provide an enclosed path for the removed cleaning fluid and other toxic material. Instead, such fluid material must flow from a separation means (of a suitable filter material) into a large open washing bowl and thence to the waste container. But when the associated vapors are in the open bowl, they are directly exhausted to the ambient atmosphere. Further, the suction system employs a "Coanda Effect" to produce the suction, and the suction is split between drawing on the gun and on a small vapor hood over the open solvent bowl. The solvent bowl vapors are ejected directly to the atmosphere without filtration, condensation or collection.

None of the foregoing examples of the state of the art provide a very simple and low cost, yet highly effective cleaning apparatus for a point spray gun of the type commonly employed in automobile body repair shops throughout the world. In automobile body repair shops, while a paint spray booth may have been provided, the problem of free droplets of paint condensing onto adjacent vehicles being worked on created needless problems and required additional time to correct. Also, there has been a growing concern for not polluting the environment with toxic materials including spray paint and the like. The present invention addresses and solves these problems.

SUMMARY

A general object of the present invention is to provide a spray gun cleaning apparatus which overcomes the limitations and drawbacks of the prior art.

A more specific object of the present invention is to provide a spray gun self cleaning apparatus which causes spray from the gun nozzle emitted during cleaning to be contained and circulated through a plurality of media for scrubbing the spray to condense and remove the cleaning fluid before being returned to the ambient atmosphere and for collecting the removed cleaning fluid and other toxic material such as waste paint safely into a suitable toxic waste storage container.

Another object of the present invention is to provide a spray gun cleaning apparatus which creates both a negative pressure (suction through the apparatus to draw the discharge gas from a spray gun therethrough) and a positive pressure (compressed air through the gun) for scrubbing and discharge into the ambient environment.

A spray gun cleaning apparatus in accordance with the present invention is provided e.g. for cleaning a spray gun with a cleaning fluid driven by air pressure provided from a compressed air supply through a nozzle of the spray gun to be cleaned. The apparatus includes an interior airflow passageway, an enlarged receptacle adjacent an inlet end of the passageway for receiving the spray gun nozzle and to permit condensation of vapors by cooling expansion of the compressed air supply, and an outflow end of the passageway for discharging airflow into the ambient environment. The apparatus further includes a waste container communicating with the passageway.

At least one filter/condenser disposed within the passageway promotes condensation of the cleaning fluid vapor into liquid state, and/or stripping of the condensed liquid from the air, which liquid then passes into the waste container, preferably by gravity flow. The apparatus further includes a negative pressure generator, such as a venturi nozzle disposed in a discharge chamber at the outflow of the passageway. The negative pressure generator creates a negative air pressure relative to ambient in a manner which causes spray gun gases to be drawn from the receptacle through the filter/condenser and into the discharge chamber. Cleaning fluid vapors in the spray gun gases from the gun nozzle drawn into the inlet during cleaning flow within the passageway and are removed from the gases by the filter/condenser before being returned to the ambient. Simultaneously, the removed cleaning fluid and other toxic material such as waste paint drip or flow safely into the waste container.

These and other objects, advantages, aspects and features of the present invention will be more fully appreciated by reference to the following detailed description of a preferred embodiment, presented in conjunction with the accompanying drawing.

DETAILED DESCRIPTION OF A PREFERRED EMBODIMENT

Figure 1:
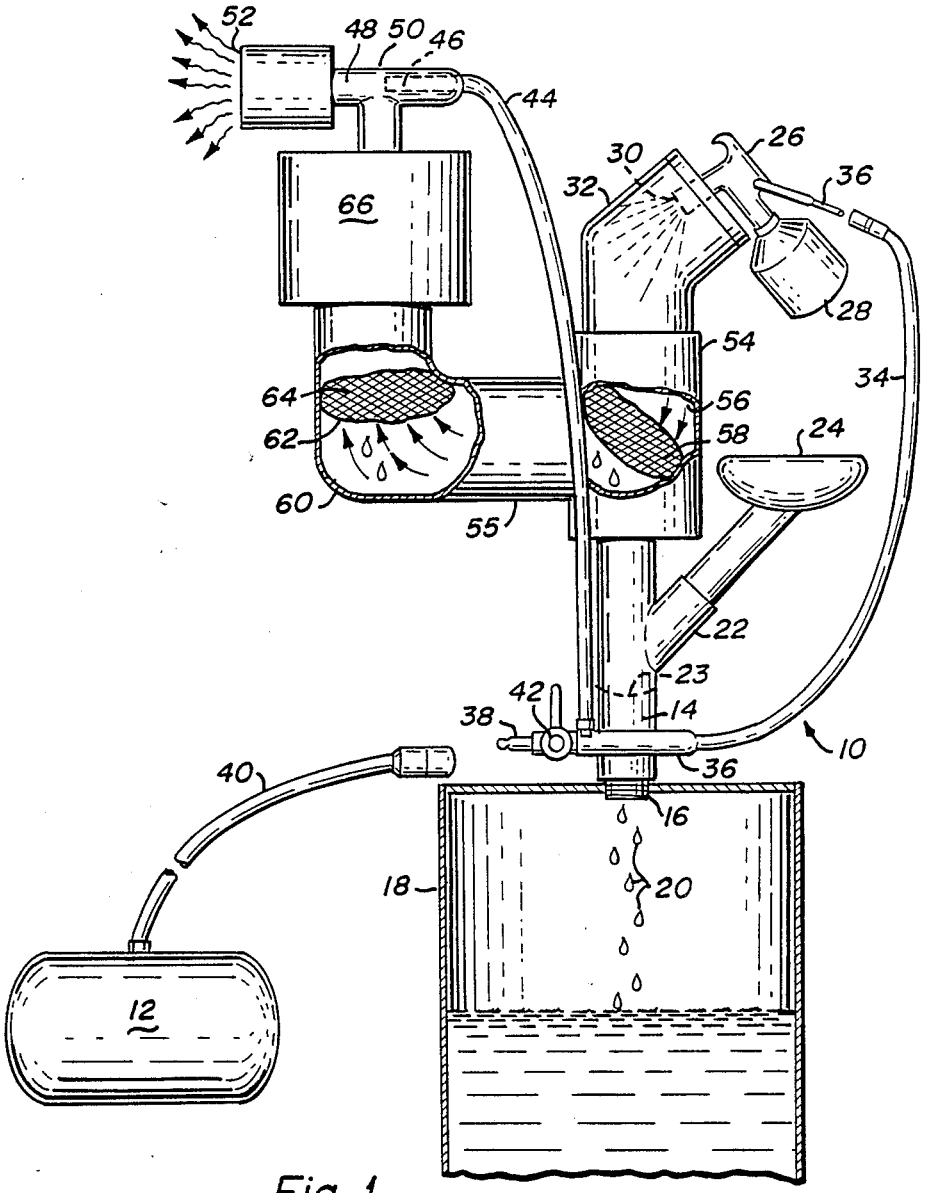
FIG. 1 is a diagrammatic view in elevation of a first preferred embodiment of paint spray gun cleaning apparatus constructed and used in accordance with the principles of the present invention.

With reference to FIG. 1, a paint spray cleaning apparatus 10 in accordance with the present invention includes a conventional source or supply 12 of compressed air, typically provided by an electrically operated air compressor and storage tank. The apparatus 10 includes a main tube 14 having a threaded fitting 16 at its lower end adapted to mate with a threaded opening of a conventional metal barrel 18, such as a 55 gallon steel drum container. Toxic liquid waste material, such as condensed cleaning solvents (symbolized by the drops 20), is collected in the drum 18 and then disposed of safely as a liquid or sludge, whenever a sufficient quantity has accumulated to make disposition thereof desired.

A wye fitting 22 in the main tube 14 branches upwardly to a widened drain basin 24 which enables the user to pour excess waste material directly into the container 18. A flow restrictor 23 comprising a transverse, curved wall or dam with a small orifice in a depressed central region is disposed in the main tube 14 in order to prevent excessive loss of negative air pressure through the air chamber of the toxic waste container barrel 18. Also, in the event that the larger opening of the barrel 18 is plugged or is occupied by other apparatus, such as reclamation equipment, the small orifice acts as a vent for the interior of the barrel 18.

A conventional paint spray gun 26 includes a gun cup 28 for holding a limited quantity of liquid material to be sprayed, and a nozzle 30 from which the liquid is dispensed as a fine mist spray by virtue of air flow. The gun 26 is shown placed into a gun receptacle 32 of the apparatus 10, the receptacle 32 being an upper end, angled extension of the main tube 14. A fitting reduces the opening of the receptacle to a suitable size to receive the head end of the spray gun 26 including the nozzle. An air hose 34 connects to a quick connect fitting 36 of the gun in conventional fashion. The hose 34 is connected through a piping and valve assembly 36 to a second quick connect fitting 38. A second air hose 40 from the air supply 12 connects to the piping and valve assembly 36 enables pressurized air from the compressed air supply 12 to enter the apparatus 10.

A pipe 44 downstream of the valve 42 leads to a venturi nozzle 46 within a discharge chamber 48 of an outlet 50. An outlet diffuser 52 at the downstream end of the discharge chamber 48 diffuses scrubbed air used to clean the spray gun 26 into the ambient environment.

A central region of the main tube 14 comprises a tee fitting 54 with a main path lying in the vertical flow path of the main tube 14, and with a branch 55 extending horizontally away from the drain basin 24. This tee fitting 54 defines an interior chamber 56 which preferably contains a first condenser 58 preferably formed of fine mesh brass wool disposed therein in the airflow path leading from the gun receptacle 32 into the branch 55. The branch 55 leads to an elbow fitting 60 creating a vertically upward flow path.

A second interior chamber 62 includes a second condenser 64 placed therein. The second condenser 64 is also preferably formed of fine mesh brass wool disposed across the airflow path. An activated charcoal media filter 66 lies directly above the second brass wool condenser 64 in the airflow path which leads directly into the discharge chamber 48.

In operation, the valve 42 is opened, and an airflow stream from the compressed air supply 12 via the valve 42 and pipe 44 is directed through the outlet diffuser 52 by the venturi nozzle 46. This primary airflow stream created by the nozzle 46 creates a negative pressure (vacuum) condition within the piping leading from the ambient and through the receptacle 32, through the first brass wool condenser 58, through the second brass wool condenser 64 and through the charcoal filter 66 and into the discharge chamber 48. This negative pressure condition causes air to flow along the path just described, as designated by the arrows in FIG. 1.

Once this negative pressure condition is established within the system 10, the spray gun may then be operated by virtue of air pressure supplied to it via the hose 34. A suitable cleaning fluid in the cup 28 is then driven through the cup tube of the gun 26 and thence through the nozzle 30 thereof. The cleaning fluid dilutes and dissolves paint and other material and they are then carried into the airstream generated by operation of the spray gun 26.

The spray from the nozzle 30 is contained within the interior of the receptacle by the vacuum condition. The spray first expands, cools and condenses in enlarged receptacle 32, then encounters the first brass wool condenser 58 wherein a significant amount of the vaporized cleaning fluid that is condensed collects into drops 20 which fall freely into the waste container 18. Then, the remaining uncondensed vapor passes with the airflow stream through the second brass wool condenser 64 wherein further scrubbing of the airflow stream occurs and condensation removes most, if not all, of the remaining cleaning fluid vapor. The condensed fluid falls as drops into the interior bottom surface of branch 55 and gets returned to the waste container 18 with the other condensed cleaning fluid. Any remaining uncondensed vapor is collected in the activated charcoal filter 66. Thus, it will be appreciated that the airflow stream reaching the discharge chamber 48 has been effectively scrubbed and purged of the cleaning fluid, and this discharge airflow stream is thereupon mixed in the discharge chamber with the primary airflow stream being put out by the venturi nozzle 46, further diluting any residual cleaning fluid vapor that might remain unpurged.

When the spray gun cleaning operation is complete, and it takes only a minute or so, the valve 42 is closed which cuts off the air supply to the system 10. Then, the cleaned spray gun 26 is removed from the receptacle 32 and may be stored away.

Since cleaning fluid vapor is the primary material being scrubbed by the condensers 58 and 64 and filtered by the filter 66, when these vapors condense into the liquid drops, the drops tend to carry away to the waste container 18 other unwanted material such as the paint removed from the spray gun 26. Thus, this apparatus 10 has a self cleaning and maintaining function which is a useful incident and byproduct of the main purpose of cleaning spray guns in an improved manner which enhances protection of the ambient environment well above whatever protection was achieved with prior apparatus and methods.

Figure 4:
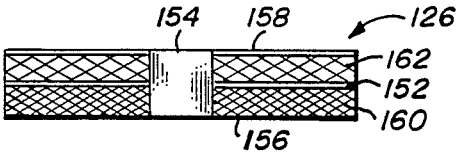
FIG. 4 is an enlarged view in side elevation and section of a filter/condenser cartridge suitable for use with the FIG. 2 apparatus.
Figure 2:
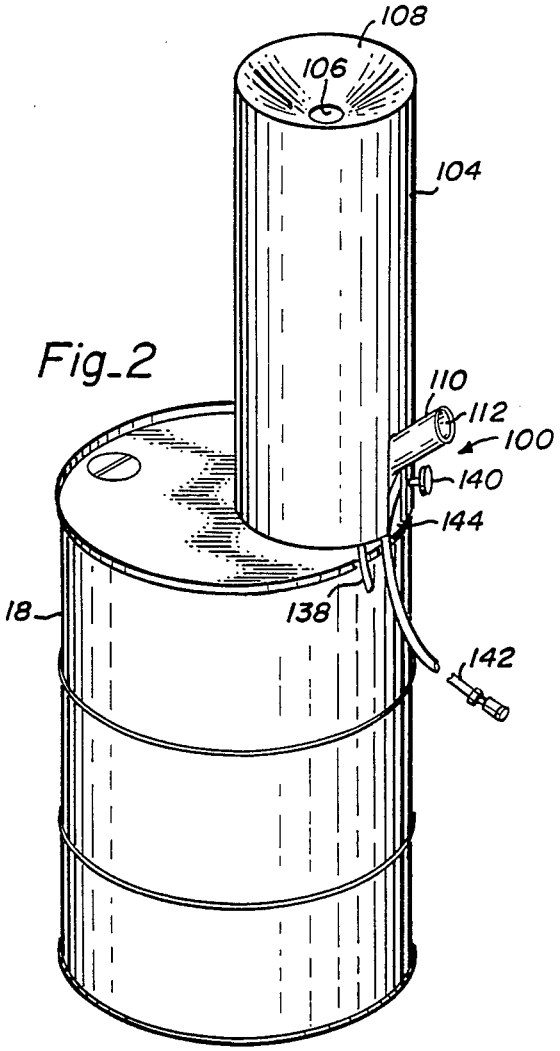
FIG. 2 is an isometric view of a second preferred embodiment of paint spray gun cleaning apparatus constructed and used in accordance with the principles of the present invention.
Figure 3:
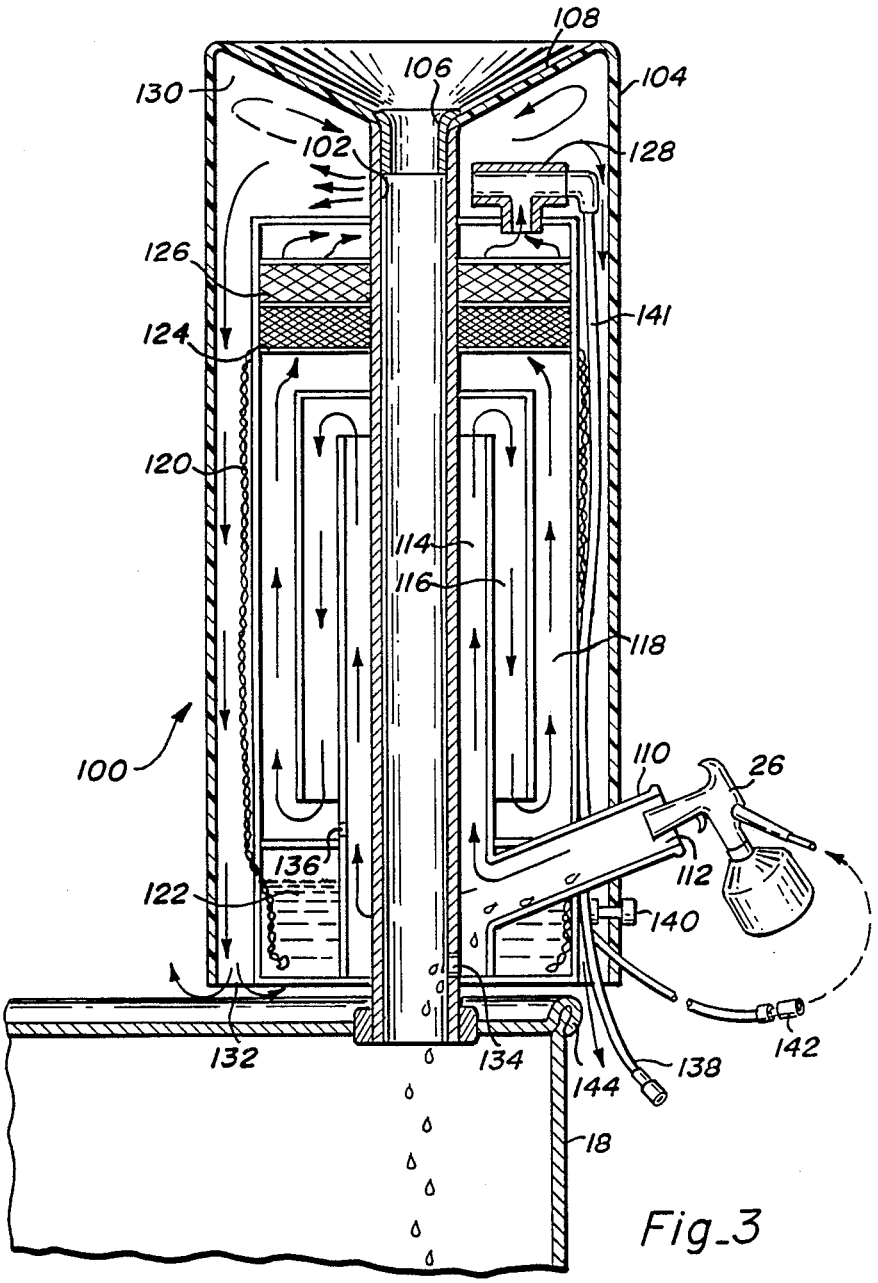
FIG. 3 is an enlarged diagrammatic view in side elevation and section of the FIG. 2 embodiment of the present invention.

Referring now to FIGS. 2, 3 and 4, a second preferred embodiment 100 of the present invention is shown. The paint spray cleaning apparatus 100 is formed as a cylindrical tower having dimensions of approximately 22 inches high by seven inches in diameter. It includes a central steel tube 102 which threads into the small diameter ($\frac{3}{4}$") opening of the standard 55 gallon drum or barrel 18 (the large (2") opening thereof shown in FIG. 2 being closed by a plug).

The apparatus 100 includes an outer cylindrical cover 104 preferably formed of molded, fiberglass reinforced cured polymer resin (epoxy) having a suitable attractive gel-coat finish. The outer cover 104 is secured to the uppermost end of the tube 102 by a suitable threaded annular fastener 106, and it integrally forms a funnel 108 with the tube 102 to provide for convenient disposal of excess toxic material into the barrel 18.

A paint spray gun receptacle 110 (analogous to receptacle 32 of FIG. 1) provides an airflow inlet 112 for the apparatus 100. The receptacle 110 is sized and positioned for receiving the nozzle end of the paint spray gun 26 to be cleaned. When the gun 26 is operated, spray from its nozzle passes through the inlet 112 and enters a series of concentric cylindrical passageways 114, 116 and 118, as denoted by the arrows in FIG. 3. These passageways are formed e.g. by steel tubes of appropriately increasing diameters, and annular end walls as shown in FIG. 3.

The outer wall of the tube forming the passageway 118 is provided with a moisture-conductive fabric jacket 120. Moisture is wicked throughout the jacket 120 by capillary flow from a water reservoir 122 formed at the base of the apparatus 100. The metal surfaces forming the reservoir 122 are appropriately coated with moisture protection coatings, such as an epoxy.

A filter/condenser cartridge ring 126 above the passages 114, 116 and 118, and directly communicating with the latter, promotes condensation and removal of solvent vapors and other toxics from the gases being discharged from the nozzle of the gun 26. The cartridge 126 may easily be removed, and a fresh cartridge inserted, merely by removing the outer cover 104.

Airflow throughout the passages 114, 116 and 118, and through the filter/condenser 126 is preferably generated by a venturi nozzle 128. This nozzle has a suction orifice leading from the gas discharge side of the filter/condenser, and has a main airflow nozzle directed into an outflow chamber 130 in a manner which creates a whirlwind or cyclone action. Ultimately, the air is discharged along an outer annular passage 132 and exhausts to the ambient atmosphere adjacent the top wall of the barrel 18.

The evaporative jacket 120 causes indirect evaporative cooling of the vapor-laden gases passing through the passageway 118, thereby promoting condensation of the solvent vapors; and it also acts as a sound deadening agent to reduce the noise otherwise generated by operation of the venturi nozzle 128. As with the FIG. 1 embodiment brass wool condensers/strippers (not shown) may be disposed within the passages 114, 116 and 118 as desired.

Two drain holes 134 and 136 permit condensed liquid material to drip into the central tube 102 and flow by gravity into the barrel 18, as shown in FIG. 3. As a result, very little cleaning fluid and other toxic materials escape from the interior of the apparatus 100, since the following effects are cumulative: the condensation by expansion of compressed gases in receptacle 112, the stripping of fluid from entraining air upon collision of the air stream/cleaning fluid mixture with the exterior of the tube 102; further stripping collisions in the passageways 114, 116 and 118; and in the filter/condenser ring 126; and final dilution by cyclone action. In addition, the fact that the air stream/fluid mixture passes adjacent to the tube 102 also adds a cooling effect and keeps evaporation of liquids within the barrel 18 (via the minimum area provided at the interior of the tube 102) to a minimum.

A pipe 138 is provided for connection to the compressed air supply 12 and leads to a valve 140 operable at the outside of the cover 104. An internal pipe 141 supplies compressed air downstream of the valve 140 to the venturi nozzle 128. A hose 142 provides compressed air to the spray gun 26 being cleaned in conjunction with the apparatus 100.

A clip 144 enables the apparatus 100 to be positively secured to the barrel 18 by attachment to its outer, upper rim.

The filter/condenser cartridge 126, FIG. 4, preferably includes a suitable housing 152 which provides for a central opening 154, thereby enabling the cartridge to fit snugly over the main tube 102, as shown in FIG. 3. The cartridge 126 may be formed in a wide variety of shapes and fashions. In one form, it includes a lower wall 156 and a wall 158, both preferably formed of brass or bronze screen through which the airstream may freely flow. Suitable condenser media, such as bronze wool 160 and/or filter media such as activated carbon or charcoal 162 may be contained within the cartridge 126. In the form illustrated in FIG. 4, the bronze wool 160 forms a lower layer transverse to the airflow, and the activated carbon 162 forms an upper layer.

Operation of the apparatus 100 is the same as for the apparatus 10 discussed in connection with FIG. 1.

IMPROVED EMBODIMENT

FIGS. 5–9 illustrate yet another embodiment of the present invention in the form of an improved spray gun cleaning apparatus 165 comprising a cupola 166 and an integrally molded basin support 167 of a fiberglass reinforced resin cured polymer. Basin support 167 is positioned atop a toxic waste container 168, typically the same as drum 18 in FIGS. 1–3. Its purpose is to funnel excess waste liquids from basin 171 and manifold 185 in cupola 166 via drain 169 into the container 168. That is, the basin support 167 is close in elevation to top surface 170 of the container 168, and hence allows the user to use less lifting effort when spent liquids must be poured into waste basin 171. Also, the compactness of the apparatus 165 (as described in association with FIGS. 2 and 3) is maintained, since the apparatus 165 can be positioned atop the drum (container) 168 and does not overhang the edges thereof.

Figure 5:
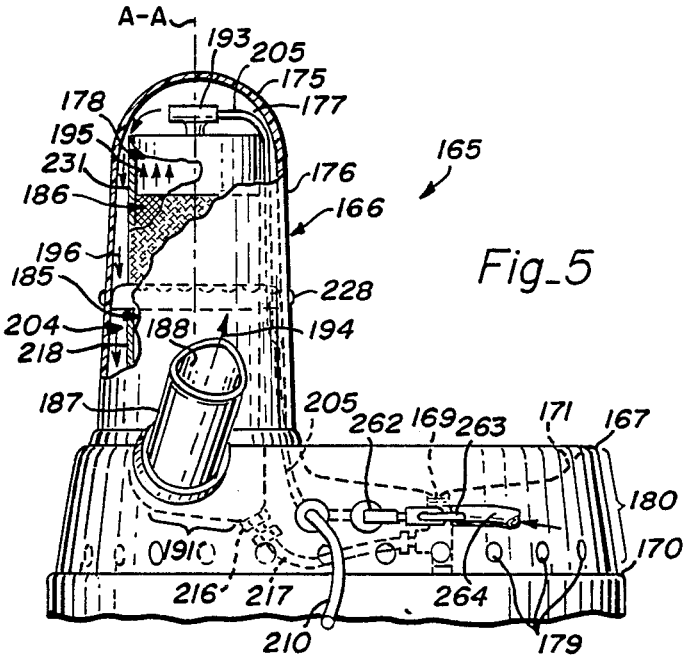
FIG. 5 is a side elevational view of yet another embodiment of the present invention in which a cupola and waste basin support are integrally molded so that the basin is in a convenient position to receive excess waste liquids atop a standard 55-gallon drum and in which the cupola contains a manifold assembly that includes a canister assembly.

Material selections and design are of importance in the efficient operation of present invention. As shown in FIG. 5, cupola 166 includes a closed top end wall 175, and a generally tapered cylindrical side wall 176 to define a central cavity 177. Cavity 177 is symmetrical about axis A—A, opens into the underside of basin support 167 to be in fluid contact with openings 179 in a depending skirt 180 of the basin support 167. Centrally supported within the cavity 177 are a manifold assembly 185 and canister assembly 186 which themselves form a disengagement space or passageway, generally indicated at 178.

OVERALL VIEW

Figure 7:
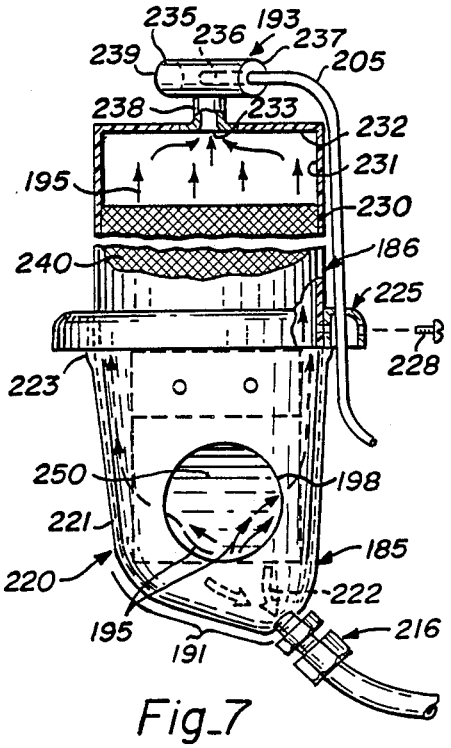
FIG. 7 is a detailed side elevational view of the canister and manifold assemblies of FIG. 5 in which the canister assembly is partially broken away to illustrate a combined condenser/filter subassembly.
Figure 8:
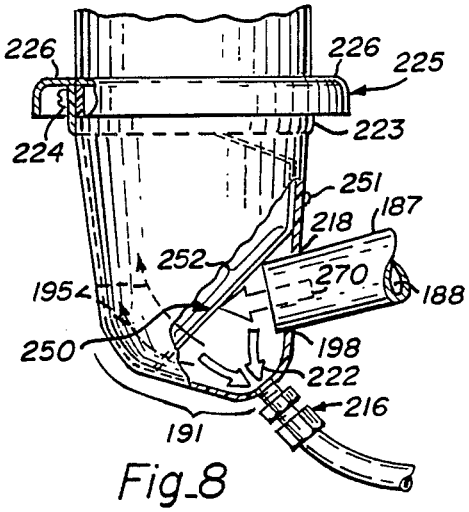
FIG. 8 is another detailed side elevation view of the canister and manifold assemblies of FIG. 7 rotated 90° to illustrate operation of a metallic shield with the receiving pipette in place.

Manifold assembly 185 and canister assembly 186, briefly perform the following functions, singly or in combination: (i) provide for condensation via expansion of the incoming spray mixture (composed of compressed air/cleaning fluid and suspended and absorbed paint) entering by way of receptacle or tube 187 to the manifold assembly 185, and (ii) stripping of liquid therefrom by collision of the mixture with baffle 250 (side walls 188 of the receptacle (tube) 187 directing the condensing liquid/air mixture into the baffle 250); (iii) collection of the liquid at nadir region 191 of the manifold assembly 185 (FIGS. 5, 7 and 8); (iv) application of suction pressure to the receptacle (tube) 187 via suction system 193 atop canister assembly 186 to draw all elements of the incoming mixture into the apparatus 165 and prevent backflow in the direction of arrow 194; (v) direct air-born, lighter elements of the incoming mixture through passageway 178 in the direction of arrows 195; (vi) further separating the air-born, lighter elements from the carrier air in the canister assembly 186; and (vii) redirecting the pressurized air stream emanating from the suction system 193 in the direction of arrows 196 through openings 179 in the skirt 180 into the atmosphere. As a result, in accordance with the invention there is provided a full closed path for containing organic compounds (i.e. cleaning fluids, solvents and the like) used in the clean up of spray gun 200 of FIG. 6.

CONSTRUCTIONAL DETAILS

Figure 6:
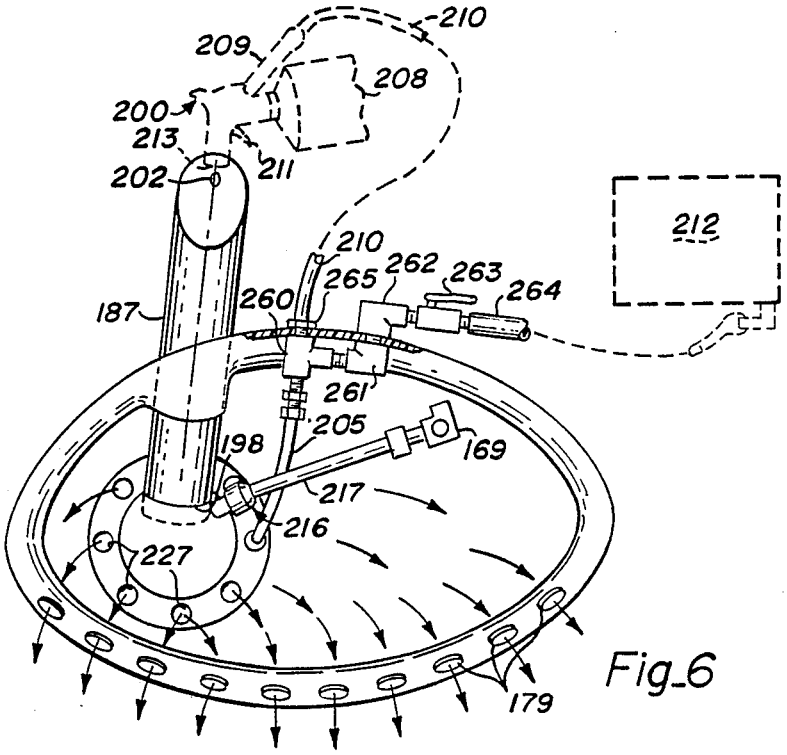
FIG. 6 is a bottom plan view of the embodiment of FIG. 5 (disconnected from its associated 55-gallon drum) illustrating air transfer connections and liquid drain tube connection to the manifold and canister assemblies.

FIG. 6 shows that tube-like receptacle 187 extends through opening 198 in the manifold assembly 185, as well as depicts spray gun 200 in an active mode for providing a pressurizes spray within the receptacle 187.

Spray gun 200 includes, in addition to reservoir 208 for the cleaning fluid to be used in the clean up operation, a coupler 209 for air line 210 and a trigger valve 211. As the trigger valve 211 is activated, a compressed air stream from supply 212 is directed through line 210 via coupler 209 to nozzle 213. The hook on the gun 200 can be hooked in hole 202, the spray gun locked in the "on" position, and let run without operator assistance for such time as is needed to clean the gun. Before the air stream exits, it creates a negative pressure that draws the cleaning fluid from reservoir 208 into contact with the air stream. The cleaning fluid exits from the nozzle 213 in atomized (aerosol) form, into tube-like receptacle 187. Since the pressure within both the receptacle 187 and nadir region 191 of the manifold assembly 185 is less that of compressed air stream of the gun 200, the cleaning fluid/air mixture undergoes expansion in accordance with Boyle's Law. Separation and removal of liquids associated with the mixture occurs in both the tube-like receptacle 187 and within the zone 191 as explained below in more detail. Angled entry of the receptacle 187 enhances operations since gravity flow is achieved; the fact that output drain coupler assembly 216 attached to nadir region 191 is lower in elevation than the receptacle 187 also aids in this regard.

FIGS. 7 and 8 illustrate the position of coupler assembly 216 relative to zone 191 of the manifold assembly 185 as well as illustrate details of both the manifold and canister assemblies 185, 186. Manifold assembly 185 includes an outer housing 220 shaped like an inverted bowl that is preferably formed of fiberglass-reinforced plastic. Inverted crown 221 of the outer housing 220 is fitted with the coupler assembly 216 at the lowest elevational position of the manifold assembly 185, to form a drain for the nadir zone 191. Because of the elevational difference, spent and separated liquid generally indicated by arrows 222 associated with the incoming air spray can be easily collected and removed from the manifold assembly 185.

Outer housing 220 of the manifold assembly 185 also includes a reserved band 223 at its highest elevational extent into which canister assembly 186 is first fitted and then attached by means of metal screws 224. The band 223 is designed to be adjacent to a L-shaped segment 225 having a wide horizontal segment 226 to provide a plurality of openings 227, see FIG. 5. Mechanically, brim segment 225 is attached to the cupola 166 of FIG. 5 by means of a series of screws, one of which being illustrated at 228. The above-mentioned mechanical connections fixes the canister and manifold assemblies 186, 185 relative to the cupola, but air line 205 is still permitted to connect to the suction system 193 atop the canister assembly 186 through one of the openings 227, see FIG. 6.

Canister assembly 186 comprises a cylindrical housing 230 formed of metal such as aluminum having a constant diameter side wall 231 that fits within and is attached to the manifold assembly 185. Housing 230 terminates in an end (top) wall 232 having an opening 233 that communicates the interior of the canister assembly 186 (including combined filter/condenser subassembly 240) to the suction system 193, which operates to remove organic compounds and prevent their passage into the atmosphere.

Figure 9:
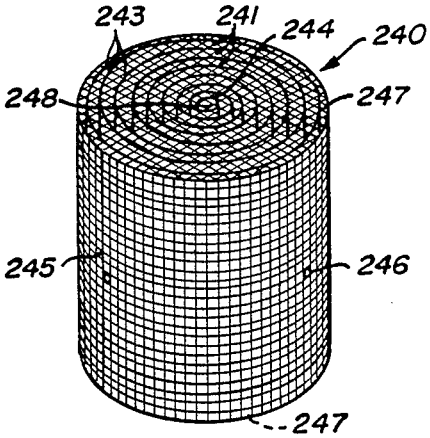
FIG. 9 is a detailed isometric view of the combined condenser/filter subassembly of FIG. 7.

FIG. 9 illustrates construction of a combined condenser/filter subassembly 240 in detail. Subassembly 240 includes a solid continuous metallic sheet 241 spiraling outward from a start position near the axis of symmetry. Between increasing diametered segments of the sheet 241 there is provided a continuous wire mesh 243. Mesh 243 is rolled first into a core 244 centered at the central axis, and then is allowed to extend beyond the outer terminus 245 of the sheet 241 before being attached thereto as by rivets 246. Similarly, mesh discs 247 at top and bottom of the condenser/filter are attached at the ends of the rolled sheet 241 via hook connectors 248.

As shown in FIG. 7, suction system 193 consists of a tee housing 235 supporting a venturi nozzle 236. The housing 235 consists of an entry arm 237, suction air arm 238 above opening 233 and an exit arm 239.

As indicated in FIG. 8, the present invention uses a condensation/collision/stripping technique to first separate the incoming spray that enters the manifold assembly 185 through receptacle 187 and opening 198. The impact of the collisions is provided mostly by the pressurized spray, and other factors include the negative pressure generated by suction system 193 and the positioning of shield 250 relative to opening 198.

FIG. 8 shows that baffle (shield) 250 is attached to side wall 218 of the manifold assembly 185 by rivets 251 so as to be positioned with its main segment 252 across the opening 198 in the path of the flow of the mixture. Angle 0, defined between a vertical and the projection of the main segment 252, identifies the relative position of the shield 250 relative to side wall 218 of the manifold assembly 185.

OPERATIONS

In the operation of the apparatus 165 of the present inventions, assume that the air line 205 for the suction vacuum system 193 (FIGS. 5 and 6) has been connected to source 212 of compressed air via tee coupler 260 elbow couplers 261, 262, valve 263 and hose 264. Note the remaining arm of the tee coupler 260 includes fitting 265 and hose 210 for providing compressed air to the spray gun 200 as previously mentioned. The valve 263 is adjusted to provide the suction system 193 with a sufficient negative pressure to draw the atomized spray into the receptacle 187 with minimum blowback.

Liquid associated with the atomized spray (such spray comprises organic cleaning fluid and diluted toxic paint or other materials; generally indicated at 270 in FIG. 8) is easily removed from the manifold assembly 185. Such removal occurs upon collision with metallic baffle 250 after the spray is directed into the baffle by the side wall 188 of the tube 187.

While a large proportion of the organic compounds used in the cleaning solvent are collected as liquid (such liquid being generally indicated by arrows 222 in FIG. 8), a portion can be in vapor form. In order to collect the latter, the present invention establishes a negative pressure within the canister assembly 186 as well as within manifold assembly 185 via the suction system 193. As a result, a vacuum-induced air stream generally indicated by the arrows 195 is created because of the action of venturi nozzle 236 of the system 193.

FIGS. 5 and 6 illustrate that after exiting and mixing with the compressed air of the suction system, the mixed stream passes along an annular-like path 204 between side wall 176 of cupola 166 and the abutting side walls 231, 218 of the canister assembly 186 and manifold assembly 185, respectively. Upstream openings 227 (FIG. 6) and downstream openings 179 in skirt 180 permit the mixed stream to exit to the atmosphere essentially free from organic fluids used in the cleaning process.

In addition, note that before the mixed air stream exits via openings 179 in the skirt 180, the stream is directed about coupler 216 and line 217 connected to drain 169. In that way during cleaning of the spray gun (i.e., with the suction system 193 activated), a cooling effect is added and keeps evaporation of any vapors with the line 217 to a minimum. In addition because the drain 169 is of a minimum size, evaporation of liquids (from the toxic waste container 168 when the suction system 193 is deactivated and the spray cleaning apparatus 165 is idle) is also minimum. The path through line 217 and thence through manifold and canister assemblies 185, 186, effectively dictates re-condensing of any evaporate. Evaporation is limited to the narrow path through the drain 169. Moreover, any evaporation path is never permitted to cross into or affect vacuum-included discharge paths to allow organic vapors to be directly passed into the atmosphere via the suction system 193. Thus in accordance with the present invention, the vacuum induced path through the manifold and canister assemblies 185, 186, prevents escape of any organic compounds that arrive at the manifold assembly 185 regardless of source.

Having thus described an embodiment of the invention, it will now be appreciated that the objects of the invention have been fully achieved, and it will be understood by those skilled in the art that many changes in construction and widely differing embodiments and applications of the invention will suggest themselves without departing from the spirit and scope of the invention. The disclosures and the description herein are purely illustrative and are not intended to be in any sense limiting.

The embodiments of the invention in which an exclusive property or privilege is claimed are defined as follow:

1. A spray gun cleaning apparatus for use in cleaning a spray gun and attached gun cup with an organic cleaning fluid, solvent or compound, said apparatus being adapted for use with a suitable toxic waste container, comprising in operative combination:

(a) a rigid main body portion defining a passageway for the transfer of fluids introduced therein, said passageway having at least three openings to an outer surface of said main body portion including:
  (i) an inlet disposed adjacent one end of said passageway defining a receptacle for receiving a nozzle of said spray gun;
  (ii) a first outlet disposed adjacent a bottom portion of said passageway medially and downstream of said inlet for discharging toxic waste material into said waste container; and
  (iii) a second outlet disposed adjacent a second end in a top portion of said passageway and downstream of said first outlet for discharging an air stream into the ambient atmosphere;

(b) first means for separating organic cleaning fluids and diluted toxic paint from toxic vapors and other gases associated therewith, said first separation means being disposed adjacent said first outlet for disposal of paint-laden fluids into said waste container through said first outlet;

(c) second means for filtering and condensing said associated toxic vapors disposed within said passageway adjacent said second air discharge outlet by vapor condensation into a liquid which flows into said waste container via said first outlet;

(d) means for generating a negative pressure relative to ambient external air pressure within said passageway upstream of said second outlet and downstream of said second filtering and condensing means to provide suction from said inlet/spray gun receptacle toward said second air discharge outlet; and (e) means for providing compressed air to both said negative pressure generator means and said spray gun, so that activation of said spray gun causes said compressed air to generate a spray of solvent and waste from said gun cup into said inlet, separation of said toxic vapors and other gases from said liquids in said spray by said first separation means, aspiration by said compressed air passing through said negative pressure generating means of said toxic vapors to pass through said second filter/condenser means to remove said vapors from said air stream before said air stream is discharged to the ambient atmosphere and the removed cleaning fluid, condensed vapors and other toxic materials to flow safely into said waste containers.

2. The apparatus set forth in claim 1 wherein said negative pressure generating means comprises a venturi nozzle disposed medial of said second filter/condenser means and said second air discharge outlet for generating said negative pressure from said compressed air as a primary air stream discharging therefrom, and wherein the generation of said negative pressure within said passageway by said primary air stream causes the air flowing from said passageway to become mixed with said primary air stream prior to discharge to the ambient atmosphere.

3. The apparatus set forth in claim 2 wherein said venturi nozzle receives its supply of compressed air from said source for generating the primary air stream, and further comprising valve means disposed within a flow line for cutting off flow of compressed air through said venturi nozzle when said apparatus is not being used.

4. The apparatus set forth in claim 3 further comprising a flow line means connected downstream of said valve means and extending adjacent to said receptacle for simultaneously supplying air to said spray gun to be cleaned with said apparatus.

5. The apparatus set forth in claim 2 wherein said venturi nozzle and said second outlet are adapted to create a whirlwind or cyclone action.

6. The apparatus set forth in claim 1 wherein said filter/condenser means comprises a brass wool pad disposed in said passageway.

7. The apparatus set forth in claim 1 wherein said second filter/condenser means comprises a filter disposed within said passageway adjacent said second air discharge outlet at a higher altitude relative to said first separation means such that liquids do not come into direct contact with said filter/condenser means, said second filter/condenser being specially adapted to remove and absorb organic compounds and toxic vapors from the air flowing therethrough before passage to the ambient environment, said second filter/condenser being adapted to promote condensation of said absorbed organic compounds and vapors into liquid for disposal into said waste container.

8. The apparatus set forth in claim 5 wherein said filter comprises an activated charcoal filter.

9. The apparatus set forth in claim 1 wherein said passageway includes a branch leading to and communicating with a waste basin for enabling the user to discharge waste liquid material into the container via the apparatus.

10. The apparatus set forth in claim 1 further comprising a housing forming a funnel for enabling the user to discharge waste liquid material into the container via the apparatus.

11. The apparatus set forth in claim 1 wherein said passageway comprises a plurality of interconnected annular concentric passageways.

12. The apparatus set forth in claim 1 wherein said filter/condenser means comprises a cartridge including a metal wool condenser and a filter medium.

13. The apparatus set forth in claim 1 further comprising an elongated cylindrical housing, and wherein said passageway is formed by a plurality of concentric tubes of increasing diameter within the housing.

14. The apparatus set forth in claim 13 further comprising moisture-conductive fabric jacket means disposed about an outer one of said concentric tubes and a moisture reservoir from which moisture is wicked throughout said jacket means by capillary flow.

15. The apparatus set forth in claim 14 wherein said discharge chamber includes a cylindrical outflow passage located between an inner cylindrical wall of said housing and said outer one of said concentric tubes having said jacket means thereon.

16. The apparatus set forth in claim 14 wherein said jacket provides indirect evaporative cooling through said outer one of said concentric tubes in order to promote condensation of vapors passing through said conduit adjacent to said one of said tubes.

17. Cleaning apparatus for use in cleaning a spray gun using an organic cleaning fluid, solvent, compound or the like, housed in a chamber of said gun and driven out of a nozzle of said gun as a compressed air/mixture spray, said apparatus being adapted for use with a suitable toxic waste container and including an enlarged receptacle for receiving said spray from said gun nozzle, said receptacle including a baffle for removing liquid components of said cleaning fluid from said spray by collision of said spray with said baffle; an outlet at the other end of a passageway for discharging air into the ambient environment, said outlet including a means for filtering and condensing vapors being discharged therethrough, a negative pressure generator means for generating a negative air pressure relative to ambient in a manner which causes suction of said spray relative to said passageway thereby causing said cleaning fluid, solvent, compound or the like and associated toxic material to flow safely into said waste container; and means for providing compressed air disconnectably connected to both said negative pressure generator means and to said spray gun in such manner to operate as a source of compressed air therefore.

18. Apparatus of claim 17 including an integrally molded cupola and basin housing positioned atop said toxic waste container, said cupola extending above said basin housing, said basin housing including a waste basin in fluid contact with said waste container through a drain line, said waste basin being positioned in close proximity to a top of said waste container.

19. Apparatus of claim 17 wherein said filter/condenser means includes a manifold assembly and canister assembly in abutting, axial contact with each other and forming interiorly thereof a medial portion of said passageway in fluid connection with said spray gun nozzle receptacle.

20. Apparatus of claim 19 in which said manifold assembly includes a housing shaped like an inverted bowl, said bowl including a nadir region and a coupler assembly connected between said drain line and said nadir region.

21. Apparatus of claim 20 in which said housing includes a horizontal rim segment and an inverted crown, said rim segment being connected to said cupola, said crown including a first opening connected to said receptacle and a second opening connected to said drain line.

22. Apparatus of claim 21 with the addition of a metallic shield in fluid alignment with said first opening whereby collision of said spray of compressed air and cleaning fluid, solvent, compound and associated other materials takes places over a central region thereof.

23. Apparatus of claim 19 in which said canister assembly includes a cylindrical housing having a side wall attached within said manifold assembly and a end wall remote from said manifold assembly that includes an opening in fluid connection with said negative pressure generator means.

24. Apparatus of claim 23 with the addition of a condenser-filter subassembly within said side wall of said canister assembly for promoting vapor condensation.

25. Apparatus of claim 24 in which said condenser-filter subassembly includes a continuous spiral of sheet material forming adjacent segments, and a wire mesh interconnectably connected across said adjacent segments.

* * * * *